US006347898B1

(12) United States Patent
Rhodes et al.

(10) Patent No.: US 6,347,898 B1
(45) Date of Patent: Feb. 19, 2002

(54) DRY-EASE MARKER ERASER HAVING A FLEXIBLE TUBULAR SLEEVE WITH INTERNAL RIBS

(75) Inventors: Julia Rhodes, 150 Lower Sunset, Sonora, CA (US) 95370; Jorge Mercade, Soulsbyville, CA (US)

(73) Assignee: Julia Rhodes, Sonora, CA (US)

( * ) Notice: Subject to any disclaimer, the term of this patent is extended or adjusted under 35 U.S.C. 154(b) by 0 days.

(21) Appl. No.: 09/905,745

(22) Filed: Jul. 14, 2001

(51) Int. Cl.[7] ..... B43K 25/00; B43K 29/00

(52) U.S. Cl. ..... 401/52; 401/195; 401/88

(58) Field of Search ..... 401/52, 195, 88, 401/98; 15/424–428, 431; D19/53

(56) References Cited

U.S. PATENT DOCUMENTS

| | | | | | |
|---|---|---|---|---|---|
| 1,821,994 | A | * | 9/1931 | Van Dorn | 15/431 |
| D145,182 | S | * | 7/1946 | Mallard | D19/53 |
| 3,262,425 | A | * | 7/1966 | Waugh | 15/431 |
| 3,475,104 | A | * | 10/1969 | Larson | 401/195 |
| 5,855,442 | A | | 1/1999 | Keller | |
| 5,871,294 | A | | 2/1999 | Turner | |
| 5,957,603 | A | | 9/1999 | Bell | |
| 6,048,121 | A | | 4/2000 | Carver | |

* cited by examiner

*Primary Examiner*—David J. Walczak
*Assistant Examiner*—Tuan Nguyen
(74) *Attorney, Agent, or Firm*—Jack Lo

(57) ABSTRACT

A dry-erase marker eraser is comprised of a springy tubular sleeve with a closed end and an open end. An erasing pad is attached to the closed end of the sleeve. Longitudinal gripping ribs are arranged around an interior wall of the sleeve adjacent the open end. Longitudinal stop ribs are arranged around the interior wall of the sleeve adjacent the closed end. The open end of the sleeve is adapted to fit around a butt end of a marker. The sleeve and gripping ribs are sized to engage markers between a minimum diameter and a maximum diameter. When the sleeve is positioned around a marker of the minimum diameter, the gripping ribs are closest from each other and the open end of the sleeve has a circular shape. When the sleeve is positioned around a marker of the maximum diameter, the gripping ribs are spread apart and the sleeve is reduced in curvature between the gripping ribs to a polygonal shape.

9 Claims, 2 Drawing Sheets

DRY-EASE MARKER ERASER HAVING A FLEXIBLE TUBULAR SLEEVE WITH INTERNAL RIBS

BACKGROUND OF THE INVENTION

1. Field of the Invention

This invention relates generally to dry marker erasers.

2. Prior Art

A dry-erase marker is a felt tip pen for making erasable marks on a dry-erase surface, such as a white board. The marks may be erased with a felt eraser. However, the eraser is typically separate from the pen. A user must hold the pen in one hand and the eraser in the other hand, and constantly swap them between the hands to write and erase. Further, the separate eraser is often misplaced and not available when needed.

Various erasers known among the prior art are attachable to a marker for greater convenience. An eraser disclosed in U.S. Pat. No. 6,048,121 to Carver is comprised of an erasing pad fixed to the side of a cap for a marker. In a second embodiment, it is comprised of an erasing pad secured inside a recess at the end of the cap with a pin. In a third embodiment, it is comprised of an erasing pad attached within a tubular sleeve which is secured around the end of the cap. In a fourth embodiment, it is comprised of an erasing pad attached to a C-clip for clipping to the side of the marker. However, each of the first three embodiments fits only a single model of marker, whereas the C-clip interferes with the user's grip around the marker. Another eraser disclosed in U.S. Pat. No. 5,957,603 to Bell is comprised of an erasing pad attached to one end of a cylinder which has another end for fitting inside the hollow end of a marker. In a second embodiment, it is comprised of an erasing pad attached to one end of a cylinder which has another end for fitting externally around the end of a marker. Each embodiment also fits only a single model of marker.

Another eraser disclosed in U.S. Pat. No. 5,871,294 to Turner is comprised of an erasing pad attached to either a cap or the end of a marker. The erasing pad must be permanently adhered to the cap or marker, and cannot be reattached to another marker. Yet another eraser disclosed in U.S. Pat. No. 5,855,442 to Keller is comprised of a ring of erasing material attached around a rigid sleeve that fits around a cap of a marker. In a second embodiment, it is comprised of a cap with an erasing pad attached to a side thereof. In a third embodiment, it is comprised of an erasing pad attached to a clip which is attachable to the rim of the cap. Again, each of the embodiments can only fit a single model of marker. None of the prior art erasers which is arranged to attach to the cap or end of a marker can fit more than a single model of marker.

OBJECTIVES OF THE INVENTION

The objectives of the present eraser are:

to erase marks made by a dry-erase marker;

to be attachable to the marker to avoid being misplaced;

to be attachable to the marker for greater convenience in use; and to be attachable to a plurality of markers of different diameters.

Further objectives of the present invention will become apparent from a consideration of the drawings and ensuing description.

BRIEF SUMMARY OF THE INVENTION

A dry-erase marker eraser is comprised of a springy tubular sleeve with a closed end and an open end. An erasing pad is attached to the closed end of the sleeve. Longitudinal gripping ribs are arranged around an interior wall of the sleeve adjacent the open end. Longitudinal stop ribs are arranged around the interior wall of the sleeve adjacent the closed end. The open end of the sleeve is adapted to fit around a butt end of a marker. The sleeve and gripping ribs are sized to engage markers between a minimum diameter and a maximum diameter. When the sleeve is positioned around a marker of the minimum diameter, the gripping ribs are closest from each other and the open end of the sleeve has a circular shape. When the sleeve is positioned around a marker of the maximum diameter, the gripping ribs are spread apart and the sleeve is reduced in curvature between the gripping ribs to a polygonal shape.

DRAWING REFERENCE NUMERALS

10. Eraser
11. Sleeve
12. Closed End
13. Open end
14. Butt End
15. Marker
16. Wall
17. Erasing Pad
18. Ring
19. Gripping Pad
20. Interior Wall
21. Stop Rib
22. Air Channel
23. Marker
24. Marker
25. Eraser
26. Sleeve
27. Closed End
28. Open End
29. Gripping Rib
30. Interior Wall
31. Stop Rib
32. Eraser
33. Sleeve
34. Gripping Ribs
35. Stop Ribs
36. Interior Wall

DETAILED DESCRIPTION OF THE INVENTION

Figure 1:
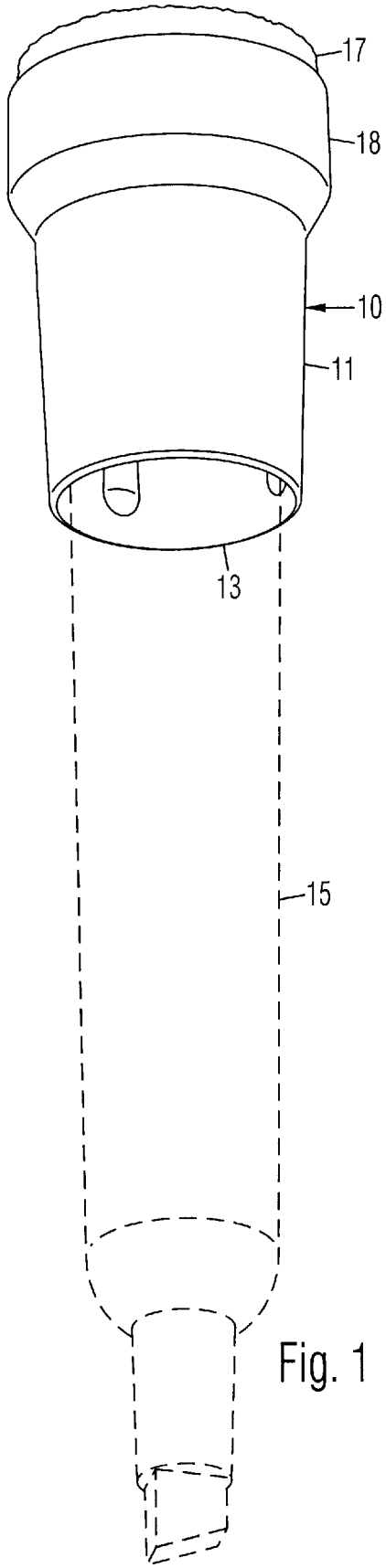
FIG. 1 is a side view of the present dry-erase marker eraser on a conventional marker.
Figure 2:
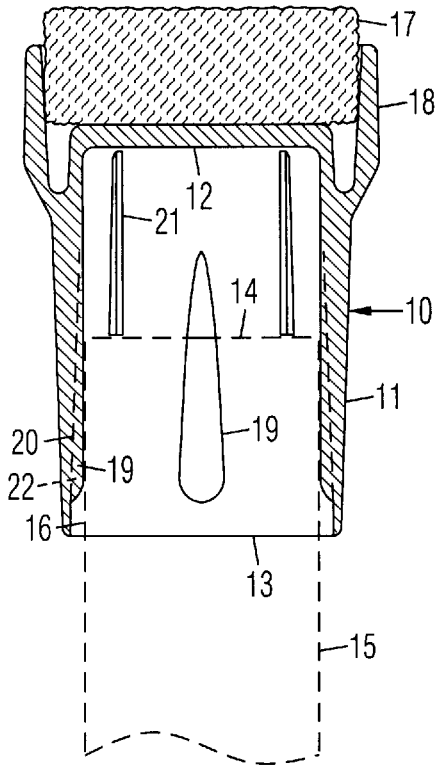
FIG. 2 is a sectional view thereof.
Figure 3:
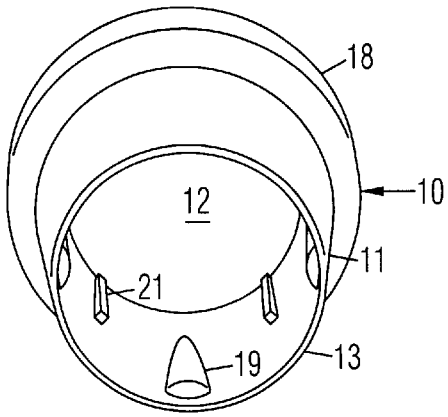
FIG. 3 is an end perspective view thereof without the marker.

FIGS. 1–3:

A first embodiment of the present dry-erase marker eraser 10 is shown in a side perspective view in FIG. 1, a sectional view in FIG. 2, and an end perspective in FIG. 3. It is comprised of a tubular sleeve 11 with a closed end 12, and an open end 13 for being positioned around a non-writing or butt end 14 of a conventional dry-erase marker 15. Sleeve 11 has an internal diameter large enough to be spaced from a wall 16 of the largest attachable marker. Sleeve 11 is made of a springy material, such as polypropylene. An erasing pad 17, such as felt or a pile material, suitable for erasing dry-erase marks is attached to the exterior of closed end 12 of tubular sleeve 11. Erasing pad 17 is preferably glued or adhered to closed end 12, but it may be attached by any other suitable method. A ring 18 is concentrically attached to sleeve 11 adjacent closed end 12. Ring 18 is positioned around a base of erasing pad 17 to prevent erasing pad 17 from being dislodged accidentally. Ring 18 is preferably larger in diameter than sleeve 11 to enable the use of an erasing pad larger in diameter than sleeve 11, but it may be of any size.

Longitudinal gripping ribs 19 are arranged around an interior wall 20 of sleeve 11 adjacent open end 13 for gripping butt end 14 of marker 15. There are preferably at least three gripping ribs 19. Interior wall 20 of sleeve 11 is preferably tapered from open end 13 to closed end 12 to facilitate molding. The central ridges of gripping ribs 19 are preferably parallel to each other and thus to the wall of marker 15, thus gripping ribs 19 are tapered toward their inner ends where wall 20 is angled inwards. Longitudinal stop ribs 21 are arranged around interior wall 20 of sleeve 11 adjacent closed end 12. Stop ribs 21 are preferably offset radially from gripping ribs 19 to facilitate molding. Stop ribs 21 are adapted for spacing butt end 14 of marker 15 from closed end 12 and preventing marker 15 from being inserted too tightly into sleeve 11. There may be any number of stop ribs 21. When marker 15 is fully inserted into sleeve 11, an air channel 22 is left between interior wall 20 and marker 15 for preventing suction from developing between closed end 12 of sleeve 11 and butt end 14 of marker 15.

Figure 4:
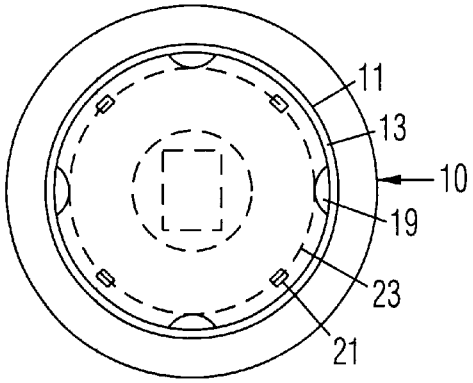
FIG. 4 is an end view thereof.

FIGS. 4–5:

Sleeve 11 and gripping ribs 19 are sized to engage different model markers between a predetermined minimum diameter and a predetermined maximum diameter. When sleeve 11 is positioned around a marker 23 of about the minimum usable diameter, as shown in FIG. 4, gripping ribs 19 are closest to each other and open end 13 of sleeve 11 has a circular shape.

Figure 5:
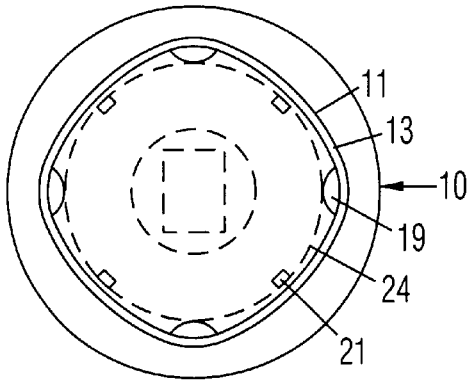
FIG. 5 is an end view thereof on a larger marker.

When sleeve 11 is positioned around a marker 24 of about the maximum usable diameter, as shown in FIG. 5, gripping ribs 19 are spread apart and sleeve 11 is reduced in curvature between gripping ribs 19 to a generally polygonal shape. Accordingly, the present eraser can be attached to markers of different diameters.

Figure 6:
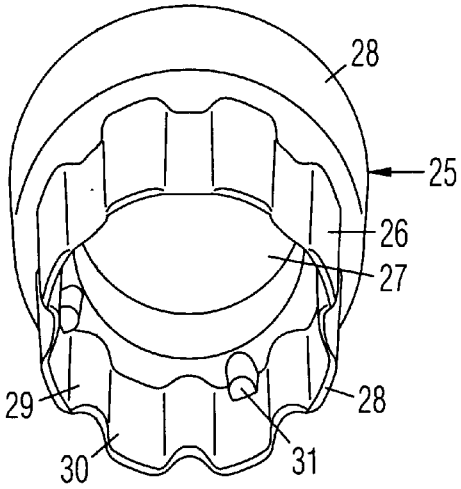
FIG. 6 is an end perspective view of a second embodiment thereof.

FIG. 6:

In a second embodiment shown in FIG. 6, a dry-erase marker eraser 25 is comprised of a corrugated tubular sleeve 26 with a closed end 27 and an open end 28. Sleeve 26 has a maximum internal diameter large enough to be spaced from the wall of the largest attachable marker. Sleeve 26 is made of a springy material, such as polypropylene. An erasing pad (not shown) is attached to the exterior of closed end 27 of sleeve 26. A ring 28 is concentrically attached to sleeve 26 adjacent closed end 27 and positioned around a base of the erasing pad. Longitudinal gripping ribs 29 comprising the corrugations of sleeve 26 are arranged around an interior wall 30 adjacent open end 28 for gripping a butt end of the marker. Longitudinal stop ribs 31 are arranged around interior wall 30 of sleeve 26 adjacent closed end 27 for spacing the butt end of the marker from closed end 27. The number of gripping ribs 29 and stop ribs 31 may vary.

Figure 7:
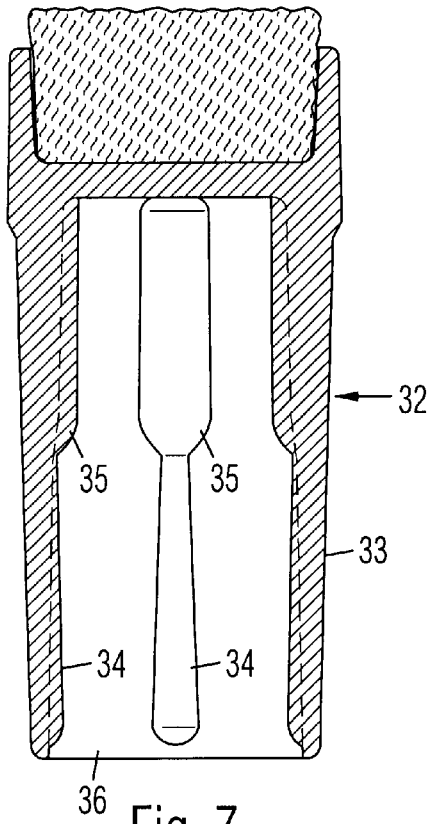
FIG. 7 is a sectional view of a third embodiment thereof.

FIG. 7:

In a third embodiment shown in FIG. 7, a dry-erase marker eraser 32 is similar to that of FIG. 1, except that tubular sleeve 33 is smaller in diameter for fitting smaller markers, either on the butt end or the cap. Also, longitudinal gripping ribs 34 are aligned with stop ribs 35 around an interior wall 36 of sleeve 33, although they may be offset as in the embodiment of FIG. 1.

SUMMARY AND SCOPE

Accordingly, the present dry-erase marker eraser erases marks made by a dry-erase marker. It is attachable to the marker to avoid being misplaced and for greater convenience in use. It is also attachable to a plurality of models of conventional markers of different diameters.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

We claim:

1. A dry-erase marker eraser, comprising:

a tubular sleeve made of a springy material and having a closed end, an open end for being positioned around a butt end of a dry-erase marker and an interior wall which is tapered from said open end to said closed end to facilitate molding;

an erasing pad attached to an exterior of said closed end of said sleeve for erasing dry-erase marks;

longitudinal gripping ribs arranged around said interior wall of said sleeve adjacent said open end for gripping said butt end of said marker, said gripping ribs being spreadable apart and said sleeve is reducible in curvature between said gripping ribs to a generally polygonal shape for being attached around markers of different diameters; and longitudinal stop ribs arranged around said interior wall of said sleeve adjacent said closed end for spacing said butt end of said marker from said closed end and preventing suction from developing between said sleeve and said butt end of said marker.

2. The dry-erase marker eraser of claim 1, wherein said tubular sleeve is comprised of a corrugated sleeve, and said longitudinal gripping ribs are comprised of corrugations in said corrugated sleeve.

3. The dry-erase marker eraser of claim 1, wherein said spring material is comprised of polypropylene.

4. The dry-erase marker eraser of claim 1, wherein said erasing pad is comprised of felt.

5. The dry-erase marker eraser of claim 1, further including a ring concentrically attached to said sleeve adjacent said closed end overlapping a base of said erasing pad to prevent said erasing pad from being dislodged accidentally.

6. A dry-erase marker eraser, comprising:

a tubular sleeve made of a springy material and having a closed end, an open end for being positioned around a butt end of a dry-erase marker, and an interior wall which is tapered from said open end to said closed end to facilitate molding;

an erasing pad attached to an exterior of said closed end of said sleeve for erasing dry-erase marks;

a ring concentrically attached to said sleeve adjacent said closed end overlapping a base of said erasing pad to prevent said erasing pad from being dislodged accidentally;

longitudinal gripping ribs arranged around said interior wall of said sleeve adjacent said open end for gripping said butt end of said marker, said gripping ribs being spreadable apart and said sleeve is reducible in curvature between said gripping ribs to a generally polygonal shape for being attached around markers of different diameters; and longitudinal stop ribs arranged around said interior wall of said sleeve adjacent said closed end for spacing said butt end of said marker from said closed end and preventing suction from developing between said sleeve and said butt end of said marker, said stop ribs being offset radially from said gripping ribs to facilitate molding.

7. The dry-erase marker eraser of claim 6, wherein said tubular sleeve is comprised of a corrugated sleeve, and said longitudinal gripping ribs are comprised of corrugations in said corrugated sleeve.

8. The dry-erase marker eraser of claim 6, wherein said spring material is comprised of polypropylene.

9. The dry-erase marker eraser of claim 6, wherein said erasing pad is comprised of felt.

* * * * *